United States Patent [19]

Savio et al.

[11] 4,106,712

[45] Aug. 15, 1978

[54] DEVICE FOR CONTROLLING THE TENSION OF YARN UNWINDING FROM A YARN SUPPORTING BODY

[75] Inventors: Ermanno Savio; Sergio Calamani; Eugenio Turri, all of Milan, Italy

[73] Assignee: SAVIO e C. S.p.A., Milan, Italy

[21] Appl. No.: 770,744

[22] Filed: Feb. 22, 1977

[30] Foreign Application Priority Data

Mar. 4, 1976 [IT] Italy ..... 20865 A/76

[51] Int. Cl.[2] ..... B65H 51/20; B65H 59/26

[52] U.S. Cl. ..... 242/47.01; 242/128; 242/153

[58] Field of Search ..... 242/47.01–47.13, 242/128, 129.8, 147 R, 149, 150 R, 153, 154; 66/132 R

[56] References Cited

U.S. PATENT DOCUMENTS

| | | | |
|---|---|---|---|
| 2,479,826 | 8/1949 | Frick et al. | 242/128 |
| 3,293,839 | 12/1966 | Yanobu | 242/153 X |
| 3,702,176 | 11/1972 | Rosen | 242/47.01 |
| 3,776,480 | 12/1973 | Lawson | 242/47.01 |
| 3,834,635 | 9/1974 | Pfarrwaller | 242/47.01 |
| 3,870,242 | 3/1975 | Schussel | 242/47.01 |
| 3,921,925 | 11/1975 | Sarfati et al. | 242/47.12 |
| 3,940,079 | 2/1976 | Vella | 242/47.12 |
| 3,995,786 | 12/1976 | Deniega | 242/47.01 |
| 4,013,238 | 3/1977 | Calamani et al. | 242/47.01 |

FOREIGN PATENT DOCUMENTS

| | | | |
|---|---|---|---|
| 1,182,754 | 3/1970 | United Kingdom | 242/129.8 |

*Primary Examiner*—Stanley N. Gilreath
*Attorney, Agent, or Firm*—Haseltine, Lake, & Waters

[57] ABSTRACT

Device for controlling the tension of yarn unwinding from a yarn supplying apparatus to using machines. The device comprises two discs facing each other and having annular recesses and projections, with the projections on one disc extending between the recesses on the other disc. One of the discs is applied on the apparatus, while the other disc is carried by the bracket and has an axial hole passing therethrough, through which hole the yarn exits, the tension of which has been controlled.

4 Claims, 1 Drawing Figure

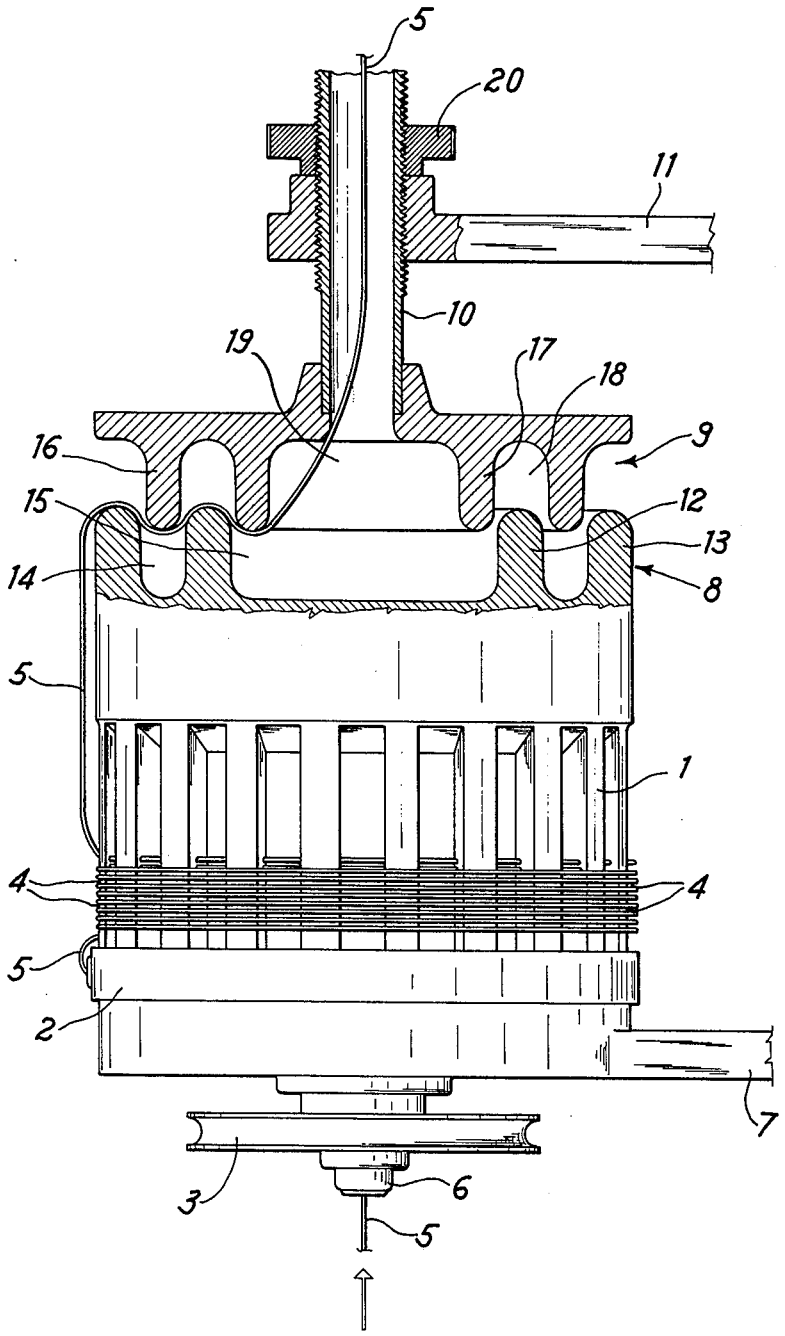
5
20
11
10
19
17
18
9
16
15
12
13
14
8
5
1
4
4
5
2
7
3
6
5

DEVICE FOR CONTROLLING THE TENSION OF YARN UNWINDING FROM A YARN SUPPORTING BODY

FIELD OF THE INVENTION

This invention relates to a device for controlling the tension of yarn unwinding from a yarn supporting body, particularly from a yarn storing apparatus, and to its supply to using machines.

PRIOR ART

It is known that when unwinding yarn from yarn bearing bodies, such as bobbins or yarn supplying apparatus to using machines, on which the yarn is wound up as turns, it is often required to control the tension of the yarn being drawn from such yarn bearing bodies. In addition to allowing a tension adjustment, the device for controlling the yarn tension should be such that the yarn passage is permitted even when the yarn has knots or any enlargements.

Many types of devices for controlling the yarn tension are known which, for example, are in the form of pan-like elements or discs facing one another and maintained against one another by a spring, the yarn passing between the two pan-like elements or discs and being braked thereby. This type of device suffers from many disadvantages, in that the control of the yarn tension is hardly adjustable to a desired rate and particularly in that, on grazing on said pan-like elements or discs, the yarn would tend to deposit thereon such foreign matter as hairs, dust or any dirt which tends to render the device unusable.

Other yarn braking devices, such as that disclosed in U.S. Pat. No. 3,702,176, comprise combs of plastic material formed of flexible fingers facing the yarn turn bearing body and below which the unwinding yarn passes, bending said fingers and lifting them away from the abutting surface. Other devices comprise hairs or bristles acting on a bell member superimposed on the bearing body for the turns of yarn, which yarn on being unwound will bend said hairs moving the same away from the bell member, such as disclosed in U.S. Pat. No. 3,834,635. Still other devices comprise somewhat elongated bristles or hairs radially projecting above the top of the bearing body for the yarn turns, as described in U.S. Pat. No. 2,479,826, the unwinding yarn being intercepted by said hairs, bending the same and being braked thereby.

Devices are also known as comprising lamellae urged by springs acting on the yarn to brake the latter, as disclosed in U.S. Pat. No. 3,093,339.

The above mentioned yarn devices suffer from disadvantages consisting, for example, in that the tension being applied therefrom to the yarn can be adjusted only by replacing the device with a different device, even though of a similar structure, and in that the tension imparted to the yarn is variable with the yarn unwinding speed or rate, and additionally also in that they tend to cause a yarn breakage, when the yarn has knots and is unwound at a high speed.

SUMMARY OF THE INVENTION

It is the main object of the present invention to provide a device for controlling the yarn tension, which is of a simple structure and assures a correct control of the tension of the unwinding yarn, independently of the yarn speed.

It is another object of the invention to provide a device of the above mentioned type which allows a very easy and ready adjustment of the yarn tension within wide ranges.

These and still other objects are accomplished by a device comprising two discs facing each other and coaxial with a yarn bearing body, to which one of said discs is integral, the other disc having an axial hole passing therethrough for the passage of the yarn, the tension of which has been controlled, said other disc being integral with a fixed bracket, the opposing surfaces of the two discs being shaped so that at least one of the discs has at least one annular recess coaxial with said one disc, and that at least the other disc has at least one annular projection coaxial with said other disc, the surface of said annular projection being substantially complemental with that of said recess, the projection of which is positionable.

BRIEF DESCRIPTION OF THE DRAWING

In order that the structure and features of the device be more clearly understood, an embodiment thereof will now be described, as given by mere way of unrestrictive example, with reference to the accompanying drawing, the single FIGURE of which is a part sectional view showing a device for controlling the yarn tension mounted on the head of a known type of yarn storing and supplying apparatus.

DETAILED DESCRIPTION

The single FIGURE of the accompanying drawing shows a drum 1, at the base of which a hollow rotary arm or disc 2 rotatably driven by a pulley 3 connected to a motor by a belt, not shown in the drawing, distributes in the form of turns 4 a yarn 5 arriving, for example, from a yarn bobbin or spool and passing through a hollow hub 6 forming part of the supplying apparatus.

Said pulley 3, hollow hub 6 and rotary arm 2 are rotatably carried on a fixed bracket 7, while said drum 1 is supported by the bracket in the manner of U.S. Pat. Nos. 3,093,339, 3,776,480, 3,834,635.

The yarn turns 4 distributed at the base of drum 1 by the rotary arm 2 are displaced in upward direction relative to the FIGURE by oscillating plates.

The structure of the supplying apparatus or feeder thus far described is not significant for the purposes of the present invention, but for affording the operation of the yarn tension adjusting device, and is well known. Feeders of this type have been disclosed, for example, in U.S. Pat. Nos. 2,625,340, 3,093,339, 3,419,225, 3,672,590, 3,702,176, 3,776,480 and 3,834,635.

The device according to the present invention has the purpose of controlling the tension of yarn 5 unwinding from the upper end of drum 1.

Such a device comprises a disc 8 applied to the upper end of the feeding apparatus and a disc 9, coaxial with and facing said disc 8, disc 9 being mounted at one end of a hollow shaft 10 carried by a fixed bracket 11.

As it will be seen from the drawing, two annular ribs 12 and 13, respectively, protrude from disc 8 and defines two annular recesses 14 and 15, respectively. Two annular ribs 16 and 17, respectively, protrude from the surface of disc 9 facing said disc 8, these annular ribs 16 and 17 also defining two annular recesses 18 and 19, respectively.

It can be seen from the drawing that the surfaces defining the ribs and recesses, respectively, of one disc are complemental with the surfaces defining the recesses and ribs, respectively, of the disc opposite thereto, so that the ribs projecting from one disc can enter and be seated in the recesses of the disc facing thereto.

An axial hole passes through disc 9 and is coincident with the axis of the hollow shaft 10, the latter having its outside surface formed with a thread engaging with the thread formed in a hole of the fixed bracket 11 so that, by rotating said shaft 10 about its own axis, disc 9 can be moved towards or away from disc 8. After being positioned as desired, said disc 9 can be steadily clamped by means of a ring nut 20 screwed down on shaft 10.

When considering the FIGURE of the accompanying drawing, it will be appreciated that the yarn 5 unwinding from drum 1 and entering inside the tubular shaft 10 follows, between the ends of the projecting ribs of the two discs, a sinusoidal path which is at a higher or lower level depending on disc 9 being more or less close to disc 8, as it can be readily understood.

It will be readily appreciated that by this arrangement the tension of yarn 5 can be adjusted within wide ranges and at any desired rate, by merely moving said disc 9 towards or away from disc 8.

It can also be noted that yarn 5, unwinding from drum 1, rotates all about said drum, that is said yarn rotates all about the projecting ribs of the two discs, which are therefore self-cleaning, since on circularly grazing on the ribs, said yarn tends to remove any residue possibly left on the ribs by a preceding length of yarn.

What we claim is:

1. A device for controlling the tension of yarn unwinding from a yarn bearing body, particularly from a yarn storing and supplying apparatus, wherein: the device comprises two discs facing each other and coaxial with said yarn bearing body, to which one of said discs is integral, the other disc being provided with an axial hole passing therethrough for the passage of the yarn of which the tension has been controlled, said other disc being supported on a fixed bracket; the discs being defined by opposite faces so that at least one of the discs has at least one annular recess coaxial therewith and the other disc is provided with an annular projection coaxial therewith, the surface of said annular projection being substantially complemental with that of said recess for positioning said projection.

2. A device according to claim 1, wherein the opposing surfaces of said discs are both shaped with at least one of said recesses and at least one of said projections.

3. A device according to claim 1, wherein said disc supported by said bracket is mounted on a hollow shaft carried by the bracket, and means being provided for varying the axial position of said hollow shaft on said bracket.

4. A device according to claim 3, wherein; the outside surface of said hollow shaft is at least partially threaded and engages in the thread of a hole in said bracket, form said means for varying the positioning of said shaft on said bracket.

* * * * *